US011655524B2

(12) United States Patent
Yang et al.

(10) Patent No.: US 11,655,524 B2
(45) **Date of Patent: *May 23, 2023**

(54) COPPER ALLOY WITH EXCELLENT COMPREHENSIVE PERFORMANCE AND APPLICATION THEREOF

(71) Applicant: NINGBO POWERWAY ALLOY MATERIAL CO.,LTD., Zhejiang (CN)

(72) Inventors: Chaoyong Yang, Zhejiang (CN); Ning Li, Zhejiang (CN); Jiangang Li, Zhejiang (CN); Hongbin Zhao, Zhejiang (CN); Taisheng Yang, Zhejiang (CN); Yaohua Zhou, Zhejiang (CN)

(73) Assignee: NINGBO POWERWAY ALLOY MATERIAL CO., LTD., Zhejiang (CN)

( * ) Notice: Subject to any disclaimer, the term of this patent is extended or adjusted under 35 U.S.C. 154(b) by 105 days.

This patent is subject to a terminal disclaimer.

(21) Appl. No.: 16/487,428

(22) PCT Filed: Sep. 4, 2018

(86) PCT No.: PCT/CN2018/000311

§ 371 (c)(1),
(2) Date: Aug. 20, 2019

(87) PCT Pub. No.: WO2020/034049

PCT Pub. Date: Feb. 20, 2020

(65) Prior Publication Data

US 2021/0062301 A1 Mar. 4, 2021

(30) Foreign Application Priority Data

Aug. 17, 2018 (CN) ..... 201810939276.4

(51) Int. Cl.
*C22C 9/02* (2006.01)
*C22F 1/08* (2006.01)

(52) U.S. Cl.
CPC ..... *C22C 9/02* (2013.01); *C22F 1/08* (2013.01)

(58) Field of Classification Search
CPC ..... C22C 9/02; C22F 1/08
See application file for complete search history.

(56) References Cited

U.S. PATENT DOCUMENTS

| | | | | |
|---|---|---|---|---|
| 4,337,089 | A * | 6/1982 | Arita | C22C 9/06 420/472 |
| 6,379,478 | B1 * | 4/2002 | Farquharson | C22C 9/06 420/472 |
| 2002/0029827 | A1 | 3/2002 | Liu et al. | |
| 2008/0314612 | A1 * | 12/2008 | Takahashi | H01B 1/026 148/685 |
| 2013/0209825 | A1 * | 8/2013 | Okafuji | C22C 9/00 428/546 |
| 2014/0014241 | A1 * | 1/2014 | Kuwagaki | C22C 9/00 148/554 |
| 2020/0071805 | A1 * | 3/2020 | Li | C22F 1/08 |

FOREIGN PATENT DOCUMENTS

| | | |
|---|---|---|
| CN | 1986857 | 6/2007 |
| CN | 101314825 | 12/2008 |
| CN | 108285988 | 7/2018 |
| JP | 2008127668 A * | 6/2008 |

OTHER PUBLICATIONS

"International Search Report (Form PCT/ISA/210) of PCT/CN2018/000311," dated May 6, 2019, pp. 1-4.

* cited by examiner

*Primary Examiner* — Anthony J Zimmer
*Assistant Examiner* — Jacob J Gusewelle
(74) *Attorney, Agent, or Firm* — JCIP Global Inc.

(57) ABSTRACT

The invention is a copper alloy with excellent comprehensive performance, including the following components in percentage by weight: 0.4 wt %-2.0 wt % of Ni, 0.2 wt %-2.5 wt % of Sn, 0.02 wt %-0.25 wt % of P, 0.001 wt %-0.5 wt % of Si, and the balance of Cu and unavoidable impurities. The copper alloy has a yield strength of 550 MPa or above, and an electrical conductivity of 38% IACS or above. A bending workability is as follows: the value of R/t in the GW direction is less than or equal to 1, and the value of R/t in the BW direction is less than or equal to 2; and after the copper alloy is kept at 150° C. for 1000 hours, a residual stress rate is greater than or equal to 75%, and the stress relaxation resistance is excellent.

5 Claims, No Drawings

COPPER ALLOY WITH EXCELLENT COMPREHENSIVE PERFORMANCE AND APPLICATION THEREOF

CROSS-REFERENCE TO RELATED APPLICATION

This application is a 371 application of International PCT application serial no. PCT/CN2018/000311, filed on Sep. 4, 2018, which claims the priority benefit of Chinese application no. 201810939276.4, filed on Aug. 17, 2018. The entirety of each of the above—mentioned patent applications is hereby incorporated by reference herein and made a part of this specification.

BACKGROUND

Technical Field

The invention relates to the technical field of copper alloys, and in particular to a copper alloy with excellent comprehensive performance and application thereof.

Description of Related Art

Copper and copper alloy materials with high strength and good electrical conductivity have long been ideal raw materials for connectors, terminals and switches. In recent years, with the development of miniaturization, lightweight, and high integration of consumer electronics and automotive electronic components, higher requirements have been placed on the comprehensive performance of raw materials.

Since the cross-sectional area of a connector is reduced after the connector is miniaturized, in order to compensate for the decrease in contact pressure and electrical conductivity caused by the reduction in the cross-sectional area, the metal material of the connector is required to have higher strength and electrical conductivity. With the miniaturization of connectors and terminals, the radius of curvature of the bending work of a contact portion becomes small, and the material is required to have more stringent bending workability than ever. However, there is a trade-off relationship among the electrical conductivity, the bending workability and the strength, and it is difficult to improve these properties at the same time.

Copper alloy materials commonly used in connectors and terminals include brass, phosphor bronze, copper nickel silicon and beryllium bronze. Among them, although the cost of brass is low, it is rarely applied to fields having a high requirement for strength and electrical conductivity. Tin phosphorus bronze is a copper alloy widely used in the fields of connectors and terminals. It has high strength, but its conductivity is only 18% IACS, which cannot meet the application requirements of high-performance connectors for high-conductivity working condition. Moreover, considering the high price of tin, the application of tin phosphor bronze in some fields is limited. Beryllium contained in beryllium bronze is toxic, and beryllium bronze is expensive and is generally only used in certain fields where high elasticity and strength are required. As an aging precipitation strengthened alloy, a copper-Ni—Si alloy is developed to replace beryllium bronze, but since its cost is much higher than phosphor bronze, the copper-Ni—Si alloy is usually applied to the field of high-end connectors.

A Cu—Ni—Sn alloy represented by an alloy C19025 is a commonly used alloy with both performance and cost advantages. However, when the yield strength of the alloy is greater than or equal to 550 MPa, the bending workability is significantly reduced, which cannot meet the requirements of miniaturization applications.

In view of the above-mentioned deficiencies of the existing materials, the invention obtains a copper alloy material with a yield strength of 550 MPa or above, a conductivity of 38% IACS or above and excellent comprehensive performance including stress relaxation resistance and bending workability by using Cu—Ni—Sn as a matrix through composition adjustment, and precipitation phase and texture control.

SUMMARY

The technical problem to be solved by the invention is to provide a copper alloy with excellent comprehensive performance and application thereof. The copper alloy has a yield strength of 550 MPa or above, and an electrical conductivity of 38% IACS or above; its bending workability is as follows: the value of R/t in the GW direction is less than or equal to 1, and the value of R/t in the BW direction is less than or equal to 2; and after the copper alloy is kept at 150° C. for 1000 hours, its residual stress rate is greater than or equal to 75%, and the stress relaxation resistance is excellent.

The technical solution adopted by the invention to solve the above-mentioned technical problem is: a copper alloy with excellent performance, including the following components in percentage by weight: 0.4 wt %-2.0 wt % of Ni, 0.2 wt %-2.5 wt % of Sn, 0.02 wt %-0.25 wt % of P, 0.001 wt %-0.5 wt % of Si, and the balance of Cu and unavoidable impurities.

The alloy of the invention is added with element Ni. Ni can be infinitely dissolved with Cu, and solution of Ni in the copper matrix can increase the strength of the alloy. Ni has a smaller influence on the electrical conductivity of the copper alloy than elements Sn, Si, and P. Moreover, Ni can form precipitated phases in the form of a Ni—P intermetallic compound and a Ni—Si intermetallic compound with elements Si and P by a deformation heat treatment process. When the elements Ni, Si, and P are desolvated, the strength and electrical conductivity of the alloy are improved. However, elements P and Si cannot be completely precipitated through aging, and excessive P and Si in the copper matrix tend to cause the electrical conductivity of the alloy to decrease. Therefore, in order to ensure a slight excess of Ni under the premise of ensuring the strength and electrical conductivity of the alloy, the invention will control the content of the element Ni to be within a range of 0.4 wt % to 2.0 wt %.

The alloy of the invention is added with an element Sn. Sn exists as a solid solution in the copper alloy. The Zn equivalent coefficient of the element Sn is 2, and the degree of lattice distortion caused to a crystal is large, so that the alloy has a good work hardening effect in the subsequent processing. Work hardening increases the energy storage in the deformed alloy, which is contributive to forming more nucleation points for compound precipitation during the aging process, thereby improving the uniform distribution of the compound. Moreover, the element Sn can increase the thermal stability of the alloy, and can improve the stress relaxation resistance of the alloy through combination with the work hardening. The element Sn also can improve the corrosion resistance of the alloy, thereby increasing the reliability of resulting connectors for use in wet and corrosive media. However, the introduction of Sn adversely affects the electrical conductivity of the alloy. Therefore, the invention controls the content of the element Sn to be within a range of 0.2 wt % to 2.5 wt %.

The alloy of the invention is added with an element P. The element P is a good deaerator and deoxidizer for copper alloys. The element P can be dissolved in a small amount in the Cu matrix to take the effect of solution strengthening. P is also capable of forming a complex Ni—P intermetallic compound with the element Ni, such as $Ni_3P$, $Ni_5P_2$, and $Ni_{12}P_5$. The Ni—P intermetallic compound has a good strengthening effect and can increase the strength of the alloy. In addition, the alloy maintains good electrical conductivity due to precipitation of the elements Ni and P. However, when the element P is added too much, problems such as hot rolling cracking, reduction in electrical conductivity, and increase in casting difficulty are likely to occur. The invention controls the content of the element P to be within a range of 0.02 wt % to 0.25 wt %.

The alloy of the invention is added with an element Si. The element Si has a zinc equivalent coefficient of 10 in brass, and has good solution strengthening and work hardening effects. Moreover, Ni and Si are precipitated in the form of a Ni—Si intermetallic compound ($Ni_2Si$) under a suitable heat treatment process, thus achieving a good strengthening effect and improving the strength of the alloy. In addition, since Ni and Si are precipitated from the copper matrix, the alloy still can maintain good electrical conductivity. In fact, Ni and Si cannot achieve complete aging precipitation, and excessive Si in the matrix tends to cause a decrease in electrical conductivity of the alloy. Therefore, the invention controls the content of the element Si to be within a range of 0.001 wt % to 0.5 wt %.

Preferably, the crystal orientations of a strip of the copper alloy satisfy the following condition: the area ratio of brass orientation {011}<211> with a deviation angle of less than 15° is 5% to 37%, and the area ratio of the S-type orientation {123}<634> with a deviation angle of less than 15° is 5% to 30%.

Common textures of copper alloy strips are: cubic texture {001}<100>, copper-type {112}<111>, Gaussian {110}<001>, Brass-type {011}<211>, S-type {123}<634>, and R-type {124}<211> orientations, and the main texture orientations of the strip of the copper alloy of the invention are copper-type {112}<111>, cubic type {001}<100>, copper-type {112}<111>, Brass-type {011}<211>, S-type {123}<634>, and R-type {124}<211> orientations. However, if the composition ratio of these textures changes, the properties of the copper alloy strip, such as strength and bending workability, also change. Therefore, the invention achieves different properties of the material by controlling a specific texture ratio.

The texture of the strip of the copper alloy of the invention is tested by EBSD analysis. EBSD is an abbreviation for Electron Backscatter Red Diffraction, which is a crystal orientation analysis technique that utilizes diffraction Kikuchi line reflection electron diffraction generated when an electron beam is irradiated onto a tilted sample surface in a scanning electron microscope (SEM). The measurement of the Brass orientation {011}<211> and the S-type orientation {123}<634> of the strip of the copper alloy the invention is carried out under the condition that the deviation angle is less than 15°. The inventors of the present application have found through extensive experiments that the textures and texture ratios of copper alloys in the same state are not the same, and the difference in texture and texture ratio has different effects on the final properties, especially the strength and bending workability. The alloy of the invention achieves a balance between high strength and good bending workability by controlling the Brass texture and the S texture, and defining the ratios thereof. It is found that during the alloy processing, the deviation of a certain proportion of the Brass orientation {011}<211>, S-type orientation {123}<634> is more favorable to promoting the proliferation of dislocations and the disordered arrangement of atoms, which is beneficial to improving the strength of the alloy. The diversion process also promotes the increase of crystal energy storage and lattice defects, which is beneficial to the dispersion and precipitation of Ni—P intermetallic compounds and the Ni—Si intermetallic compounds in subsequent aging treatment, and is also beneficial to increasing the strength of the material. Controlling the deviation of the Brass orientation {011}<211> and the S-type orientation {123}<634> is the key to control the recrystallization behavior of the alloy, and the process of recrystallization is to control the grain size and the process of compound precipitation and distribution. The control over the grain size and precipitates of the alloy can improve the bending workability of the material. The inventors of the invention have found that when the area ratio of the Brass orientation {011}<211> with a deviation angle of less than 15° satisfies 5% to 37%, and the S-type orientation {123}<63422 with a deviation angle of less than 15° satisfies 5% to 30%, the strength and bending workability of the alloy are improved, and the excellent comprehensive performance is achieved. When it is less than or exceeds the range, it is difficult to achieve balance of various properties, and it cannot meet the high requirements of miniaturization application for high strength and good bending workability and comprehensive performance.

Preferably, the weight percentages of Ni, P, and Si satisfy: $3 \leqslant Ni/(P+Si) \leqslant 20$, and the weight percentages of Si and P satisfy: $0.1 \leqslant Si/P \leqslant 10$.

When the Ni—P intermetallic compound is used alone for strengthening, the alloy can achieve high electrical conductivity easily, but with the increase of the addition of the element P, the strength of the alloy is not improved obviously. When the Ni—Si intermetallic compound is used alone for strengthening, the alloy can achieve high strength easily, but with the increase of the addition of the element S, the electrical conductivity of the alloy deteriorates. The invention controls the ratio of the Ni—P intermetallic compound and the Ni—Si intermetallic compound by controlling the content and the ratio of the elements Ni, Si and P, and can maintain the high electrical conductivity of the alloy while improving the strength of the alloy through the synergistic effect of the Ni—P intermetallic compound and the Ni—Si intermetallic compound.

In the alloy of the invention, a Ni—P intermetallic compound or a Ni—Si intermetallic compound exists simultaneously, but a precipitation temperature differs between the Ni—P intermetallic compound and the Ni—Si intermetallic compound, and the Ni—P intermetallic compound precipitates prior to the Ni—Si intermetallic compound. The Ni—P intermetallic compound precipitated first occupies a precipitation point with high energy storage and vacancies, thereby inhibiting the segregation of the Ni—Si intermetallic compounds, effectively promoting the dispersed distribution of the Ni—Si intermetallic compounds, and thus increasing the strength of the alloy. The inventors of the invention have found that an alloy having two precipitated compounds has a better work hardening effect in a subsequent process than an alloy having a single compound. This is because the two precipitated phases act synergistically to promote dispersed distribution. The precipitated phases in dispersed distribution can leave more dislocation loops in the subsequent cold deformation process when the dislocations bypass the precipitated phase particles, thereby promoting the alloy to have a better work hardening effect. To reach the same strength, the alloy of the invention can make it with a smaller processing rate, which is advantageous for improving the bending workability of the alloy. The better work the hardening effect, in the multi-stage aging process, can promote the increase of energy storage and dislocation density in the alloy before aging, and is more conducive to the precipitation and desolvation of elements such as Ni, Si and P in multi-stage aging, thereby improving the electrical conductivity of the alloy. The inventors of the invention have found that when the weight percentages of Ni, P, and Si satisfy $3 \leqslant Ni/(P+Si) \leqslant 20$, and the weight percentages of Si and P satisfy $0.1 \leqslant Si/P \leqslant 10$, the synergistic effect between the Ni—P intermetallic compound and the Ni—Si intermetallic compounds is best, and the obtained copper alloy has the best comprehensive performance. When $Ni/(P+Si)<3$, P or Si is not sufficiently precipitated, and P or Si remaining in the matrix may seriously affect the electrical conductivity of the alloy; and when $Ni/(P+Si)>20$, the content of NiP and NiSi compounds is too little, the strength of the alloy is not improved significantly. Meanwhile, when the weight ratio of Si/P does not satisfy $0.1 \leqslant Si/P \leqslant 10$, the synergistic effect between P and Si is drastically lowered. When the weight ratio of Si/P is less than 0.1, the alloy has high electrical conductivity but low strength; on the contrary, when the weight ratio of Si/P is greater than 10, the alloy has high strength but low electrical conductivity, and the balance of properties such as strength, electrical conductivity, and bending workability cannot be realized comprehensively in the alloy ratio.

Preferably, the microstructure of the copper alloy contains a Ni—P intermetallic compound and a Ni—Si intermetallic compound, wherein average particle diameters of the Ni—P intermetallic compound and the Ni—Si intermetallic compound are both within a range of 5 nm to 50 nm.

Ni, Si, and P in the alloy of the invention can form a Ni—P intermetallic compound and a Ni—Si intermetallic compound. The precipitation of the Ni—P intermetallic compound and the Ni—Si intermetallic compound can significantly increase the yield strength of the alloy, and the finer and the more dispersive the compound, the higher the strength of the alloy. If the precipitated phases are coarse, a weak interface tends to occur, and coarse compound particles become the starting point of damage, greatly increasing the risk of cracking of the alloy strip during bending. The fine and dispersed compound particles can simultaneously achieve sufficient pinning fixation effect, can suppress the slip of dislocations so that the alloy achieves good stress relaxation resistance. Therefore, in the invention, the average particle diameters of the Ni—P intermetallic compound and the Ni—Si intermetallic compound are controlled to be within a range of 5 nm to 50 nm, respectively.

Preferably, the copper alloy further includes 0.01 wt %-0.5 wt % of Mg and/or 0.1 wt %-2.0 wt % of Zn.

Mg has the effects of deoxidation, desulfurization and a capability of improving the stress relaxation resistance of the alloy. The element Mg has a zinc equivalent coefficient of 2, and has little effect on the electrical conductivity of the alloy, which can improve the work hardening effect of the alloy to some extent. During the aging precipitation of the alloy, the work hardening effect is improved, and Mg is favorable for improving the energy storage in the material and improving the nucleation point when the compounds are precipitated. However, if the Mg content is too large, the casting property and the bending workability of the alloy are liable to be lowered. Therefore, the invention controls the Mg content to be within a range of 0.01 wt % to 0.5 wt %.

Zn has a large solid solubility in the copper matrix, and when it is dissolved in the copper matrix, the strength of the alloy can be improved, and the work hardening effect in the cold working process is promoted. In addition, Zn can also improve the casting property, weldability and stripping resistance of the clad layer. If the Zn content is too low, the solution strengthening effect is not significant, and if the Zn content is too high, the electrical conductivity, bending workability and stress corrosion cracking resistance of the alloy are lowered. Therefore, the invention controls the Zn content to be within a range of 0.01 wt % to 2.0 wt %.

Preferably, the copper alloy further includes 0.1 wt %-2.0 wt % of Co.

Co forms a Co—P intermetallic compound and a Co—Si intermetallic compound with P and Si, and the precipitated strengthening phases can improve the strength of the alloy but hardly affect the influence on the electrical conductivity. Through the solution aging process, Co is precipitated as a compound and dispersed on the matrix to further increase the strength of the alloy without lowering the electrical conductivity. However, when the Co content exceeds 2.0 wt %, alloying is difficult to achieve. When the Co content is less than 0.1 wt %, a sufficient amount of precipitated phases cannot be formed to improve the material properties. Therefore, the invention controls the Co content to be within a range of 0.1 wt % to 2.0 wt %.

Preferably, the copper alloy further includes at least one element selected from Fe, Al, Zr, Cr, Mn, B, and RE, in a total amount of 0.001 wt % to 1.0 wt %.

The element Fe can refine the grain of copper alloy, improve the high-temperature strength of a copper alloy, and promote the uniform distribution of precipitated phases in aging treatment, and thus has certain precipitation strengthening effect.

Al has a deoxidization effect during the alloy smelting process, and elements Ni and Al can form complex Ni—Al compounds through solid solution and aging processes. The Ni—Al compounds can take an effect of aging strengthening.

Zr and Cr can improve the softening temperature and high-temperature strength of the alloy and improve the high-temperature stability and stress relaxation resistance of the alloy.

Mn can take an effect of deoxidization during the smelting process of the alloy so as to improve the purity of the alloy. Mn also can improve the hot workability of the alloy, improve the basic mechanical properties of the alloy, and reduce the elastic modulus of the alloy.

B can refine the alloy grains, improve the stress relaxation resistance of the alloy, and improve the hot and cold workability of the alloy.

Re has the effects of impurity removal and deoxidization during smelting, thus improving the purity of metal; moreover, it can be used as the core of crystallization during smelting, to reduce the columnar crystal content in a ingot, thus improving the hot workability of the metal.

Excessive total amount of at least one of Fe, Al, Zr, Cr, Mn, B, and Re may lower the electrical conductivity of the alloy and affect the bending workability, so the total addition amount of these elements should be controlled to be within a range of 0.001 wt % to 1.0 Wt %.

Preferably, the strip of the copper alloy has a yield strength of 550 MPa or above and an electrical conductivity of 38% IACS or above.

Preferably, the 90° bending workability of the strip of the copper alloy is as follows: the value of R/t in the GW direction is less than or equal to 1, and the value R/t in the BW direction is less than or equal to 2; after the strip of the copper alloy is kept at 150° C. for 1000 hours, its stress residual rate is 75% or above.

The alloy of the invention can be machined into strips, bars, wires and the like according to different application requirements, so as to be applied to connectors, terminals or switch parts of electric, automobile and communication devices and the like.

The alloy of the invention can be machined into strips, bars, wires and the like according to different application requirements. Taking the strip as an example, its preparation process includes the following steps:

Batching→semi-melting casting→hot rolling→quenching→face milling→primary cold rolling→primary aging→secondary cold rolling→secondary aging→tertiary cold rolling→low-temperature annealing.

The specific implementation process is as follows:

1) Batching: All components are prepared according to a ratio.

2) Smelting: The copper alloy raw material is melted at 1100° C. to 1250° C., and then formed into an ingot by semi-continuous casting.

3) Hot rolling: The hot rolling blanking temperature of the alloy is controlled to be within a range of 700° C. to 900° C., and the holding time is 3 hours to 6 hours. The finish rolling reduction ratio of the alloy is controlled to be 85% or above. The solution treatment of the alloy of the invention can be carried out 1 minute to 5 hours at 700° C. to 900° C. through the hot rolling heating and heat preservation process.

The hot rolling process ensures that the coarse precipitated phases existing in the ingot are solid-dissolved to the matrix again and the purpose of homogenization is also achieved. In order to minimize the precipitation of phase particles after hot rolling, the finishing temperature is controlled to be 600° C. or above. In order to reduce the insufficient dissolution of elements Ni, Si and P in the solution treatment, the supersaturation of the matrix should be increased. The solution temperature is controlled between 600° C. and 900° C. If the temperature is too high, the phenomenon of tissue overburning tends to occur. The solution treatment is a heat treatment for re-forming a solute element solid solution in a matrix and performing recrystallization. After solution treatment, the proportion of cubic orientation {001}<100> along the rolling direction is increased, and the proportion of Cu-type orientation {112}<111>, Brass orientation {011}<211>, S-type orientation {123}<634>, and R-type orientation {124}<211> is reduced. This transformation is beneficial to improving the shaping of the alloy and facilitates the later cold working. The solution treatment is preferably carried out at 700° C.-850° C. for 1 minute to 5 hours, more preferably 10 minutes to 50 minutes. If the solution treatment temperature is too low, recrystallization is incomplete, which is not conducive to the control over the cubic orientation {001}<100>, the Cu-type orientation {112}<111>, the Brass orientation {011}<211>, the S-type orientation {123}<634> and the R-type orientation {124}<211> along the rolling direction, which is not conducive to subsequent processing. The re-dissolution of the solute element into the solid solution is also insufficient. On the other hand, if the solution treatment temperature is too high, the crystal grains become coarse and the hot and cold workability deteriorates.

4) Quenching: The alloy is rapidly quenched after hot rolling. The temperature at the end of hot rolling is controlled to be higher than the solution temperature of elements Ni, Si, and P, and rapid on-line quenching is performed to achieve the purpose of solution treatment.

5) Face milling: Face milling is used to remove the oxide scale on the surface of the alloy after hot rolling, the upper and lower faces of the hot rolled plate are milled by 0.5 mm-1.0 mm, respectively.

6) One-time cold rolling: The total rolling reduction ratio of cold rolling is controlled to be 80% or above. This is favorable for the uniform and sufficient precipitation of the compounds in the later aging process and also for controlling the grain structure uniformity of the recrystallization softening process of the alloy.

7) Primary aging treatment: The aging temperature is controlled to be within a range of 300° C. to 600° C. The holding time is controlled to be within a range of 3 hours to 12 hours.

It is the key process for precipitation strengthening of the alloy, and the primary aging treatment mainly achieves the purpose of second phase precipitation and tissue softening. Relative to the cold-rolled state, the alloy after aging has a small distribution ratio of Brass orientation {011}<211>, S-type orientation {123}<634>, R-type orientation {124}<211>, and Cu-type orientation {112}<111> along the rolling direction, and the alloy has good plasticity. The aging temperature is controlled to be within a range of 300° C. to 600° C., and the holding time is 3 hours to 12 hours; more preferably, the temperature is controlled to be within a range of 350° C. to 550° C., and the holding time is 4 hours to 10 hours, so that Ni forms compounds with Si and P, and the compounds are dispersed and precipitated in the copper matrix phase in a fine shape; both high strength and excellent bending workability are achieved. If the aging temperature is too high and the aging time is long, the precipitates are coarsened, and the optimum match between strength and grain size cannot be reached; on the contrary, if the aging temperature is low and the aging time is short, the precipitation cannot be sufficiently performed, which affects the strength and bending workability of the finished product.

8) Secondary cold rolling: The deformation of the secondary cold rolling is controlled to be 40% or above.

Secondary cold rolling: the heat-treated copper alloy material is cold rolled, and with the progress of cold rolling, the Cu-type orientation {112}<111>, Brass orientation {011}<211>, S-type orientation {123}<634>, R-type orientation {124}<211> along the rolling direction are all gradually increasing. The rotation of the crystal promotes the dislocation multiplication and the disordered arrangement of atoms. The increased energy storage and lattice defects in the material promote the further desolvation and uniform and fine distribution of the precipitates in the subsequent aging treatment, and improve the electrical conductivity, yield strength and bending workability of the material. Therefore, the deformation of the secondary cold rolling is controlled to be 40% or above, the deformation is too small, the precipitated phases are not dispersed uniformly, the precipitation amount is small, and it is not conducive to the completion of the complete recrystallization of the subsequently aged microstructure and is also not favorable for the final bending workability of the strip.

9) Secondary aging treatment: The aging temperature is controlled to be within a range of 300° C. to 600° C. The holding time is controlled to be within a range of 3 hours to 12 hours.

The secondary aging treatment mainly achieves the purpose of second phase precipitation and tissue softening. Relative to the cold-rolled state, the alloy after aging has a small distribution ratio of Brass orientation {011}<211>, S-type orientation {123}<634>, R-type orientation {124}<211>, and Cu-type orientation {112}<111> along the rolling direction, and the alloy has good plasticity. The aging temperature is controlled to be within a range of 300° C. to 600° C., and the holding time is 3 hours to 12 hours; more preferably, the temperature is controlled to be within a range of 350° C. to 550° C., and the holding time is 4 hours to 10 hours, so that Ni forms compounds with Si and P, and the compounds are dispersed and precipitated in the copper matrix in a fine shape; both high strength and excellent bending workability are achieved. If the aging temperature is too high and the aging time is long, the precipitates are coarsened, and the optimum match between strength and grain size cannot be reached; on the contrary, if the aging temperature is low and the aging time is short, the precipitation cannot be sufficiently performed, and bending workability and strength cannot be improved.

10) Tertiary cold rolling: the working rate of pre-cold rolling should not exceed 60%. It is selected according to the application performance.

Applying cold deformation to the alloy after aging is favorable for the further improvement of the strength of the strip, but the deformation should not be too large, and too large deformation may cause easy formation of obvious anisotropism, which is not favorable for the bending workability of the strip in the BW direction and also affects the control over the crystal grains of the alloy. With the increase of working rate, the distribution proportion of the Cu-type orientation {112}<111>, Brass orientation {011}<211>, S-type orientation {123}<634>, R-type orientation{124}<211> along the rolling direction increases, and among them, the proportion of the Brass orientation {011}<211> and the S-type orientation {123}<634> increase obviously in particular. This rotation of the crystal face orientations causes deterioration of the crystal deformation coordination and the bending workability of the alloy. The deterioration of the bending workability in the BW direction is more obvious. Therefore, the deformation is controlled to be 60% or less.

11) Low-temperature annealing: The temperature of the low-temperature annealing is controlled to be within a range of 200° C.-350° C.

Low-temperature annealing eliminates residual stress and contributes to the improvement of stress relaxation resistance. The elimination of stress can reduce the deformation of a plate under temperature and stress in subsequent applications. When the alloy is aged at low temperature, there is a certain compound precipitation effect, and the precipitation of the compounds can pin dislocations to improve the stress relaxation resistance of the alloy. Different annealing temperatures are selected according to the application requirements, and the temperature to be selected is controlled between 200° C. and 350° C. When the temperature is too high, the alloy softens. When the temperature is lower than the above value, the residual stress removal is insufficient.

12) Wash, slit and package the obtained product is washed, slitted and packaged.

Compared with the prior art, the invention has the following advantages:

(1) According to the alloy of the invention, by adjusting and controlling the composition ratio between Ni, Si and P, Ni—P intermetallic compound and Ni—Si intermetallic compound precipitate phases are formed on the basis of Cu—Ni—Sn and are dispersed and precipitated in the matrix; by adjusting the specific texture ratio, the electrical conductivity of the material is maintained and the strength and bending workability of the material are also improved.

(2) According to the alloy of the invention, the composition ratio of Ni, Si, and P is adjusted to satisfy the following: $3 \leqslant Ni/(P+Si) \leqslant 20$, $0.1 \leqslant Si/P \leqslant 10$, the synergistic effect between the Ni—P intermetallic compound and the Ni—Si intermetallic compound is fully realized to improve the strength of the material without reducing the electrical conductivity of the material.

(3) The invention defines the texture orientation ratio of the Brass orientation and the S-type orientation of the alloy, wherein the area ratio of the Brass orientation {011}<211> with a deviation angle of less than 15° is 5% to 37%, and the area ratio of the S-type orientation {123}<634> with a deviation angle of less than 15° is 5% to 30%, so that the alloy has good bending workability under the condition of high yield strength, meeting the requirement for miniaturization applications.

(4) The invention controls the average particle diameter of the Ni—P intermetallic compound and the Ni—Si intermetallic compound to be 5 nm to 50 nm by controlling the dispersed distribution of the Ni—P intermetallic compound and the Ni—Si intermetallic compound, thereby improving the yield strength and bending workability of the alloy.

(5) After aging and cold rolling deformation, the alloy of the invention can achieve a yield strength of 550 MPa or above and an electrical conductivity of 38% IACS or above; the 90° bending workability of the strip of the copper alloy is as follows: the value of R/t in the GW direction is less than or equal to 1, the value of R/t in the BW direction is less than or equal to 2; after the strip of the copper alloy is kept at 150° C. for 1000 hours, its residual stress rate is 70% or above, and excellent stress relaxation resistance is achieved.

(6) The alloy of the invention can be machined into strips, bars, wires and the like according to different application requirements, so as to be widely applied to connectors, terminals or switch parts of electric, automobile and communication devices and the like.

DESCRIPTION OF THE EMBODIMENTS

With reference to the embodiments, the invention will be further described in detail below.

Components of copper alloys shown in the composition of various embodiments of Table 1 are smelted at a temperature of 1120° C. to 1200° C. by semi-continuous casting to produce a 440 mm×250 mm ingot. The ingot is kept at 850° C. for 5 hours, and then hot rolled to a thickness of 16.5 mm. Then, due to the surface descaling, the face milling is to be performed, and the upper and lower faces of the hot rolled plate are respectively milled by 0.5 mm-1.0 mm to 15 mm; thereafter, the plate having a thickness of 2 mm is obtained through primary cold rolling; the plate after the primary cold rolling is heated to 400° C. and kept at this temperature for 8 hours for the primary aging. Then, the plate after the primary aging is subjected to secondary cold rolling to the thickness of 0.33 mm, and then kept at 360° C. for 8 hours for secondary aging treatment. Finally, finish rolling is carried out to reach the target thickness of 0.2 mm. After finish rolling, the plate is kept at 240° C. for 4 hours for low-temperature annealing to obtain a strip sample.

For the prepared strip samples of 20 embodiment alloys and 7 reference alloys, mechanical properties, electrical conductivity, stress relaxation resistance, bending workability, crystal orientations, and the average particle diameter of the precipitates are respectively tested.

The room temperature tensile test is carried out in accordance with GB/T 228.1-2010 Metallic Materials-Tensile Tests Part 1: Room Temperature Test Method on an electronic universal mechanical property test machine, using 12.5 mm wide strip end samples, with a tensile speed of 5 mm/Min.

The electrical conductivity test is carried out in accordance with GB/T 3048.2-2007 Wires and Cables-Electrical Property test methods Part 2: Resistivity Tests for Metallic Materials, where the test instrument used is a ZFD microcomputer bridge DC resistance tester, with samples being 20 mm wide and 500 mm long.

The stress relaxation resistance test is carried out in accordance with JCBA T309: 2004 Bending Stress Relaxation Test Methods for Copper and Copper Alloys, where samples which are 10 mm wide and 100 mm long are taken parallel to the rolling direction, the initial loading stress value is 80% of 0.2% yield strength, the test temperature is 150° C., the test time is 1000 h.

The bending property test is carried out on a bending test machine in accordance with GBT 232-2010 Metallic Materials-Bending Test Methods, with samples being 5 mm wide and 50 mm long.

The texture test is carried out on a Pegasus XM2 EBSD device in accordance with GBT 30703-2014 Guidelines for Electron Backscatter Diffraction Orientation Analysis Methods for Microbeam Analysis, with samples being 10 mm wide and 10 mm long.

When the size of the precipitates is tested, the alloy is prepared into a sheet having a diameter of 3 mm, and the structure of the sample is observed by ion-transfer treatment on a transmission electron microscope (the device used is FEI TF20, magnification: 15000), and the average particle diameter of the intermetallic compounds precipitated from the alloy is calculated based on the observation result.

The composition and property results of Embodiments and reference examples are shown in Table 1.

According to the embodiments, it can be found that all the copper alloys of the embodiments of the invention achieve a yield strength of 550 MPa or above, an electrical conductivity of 38% IACS or above, and an excellent bending workability (i.e., the value of R/t in the GW direction is less than or equal to 1, and the value of R/t in the BW direction is less than or equal to 2.

It can be seen from reference examples 1 to 4 that when the ratios of Ni, Si, and P are different, the condition that $3 \leqslant Ni/(Si+P) \leqslant 20$ and $0.1 \leqslant Si/P \leqslant 10$ is satisfied, and the properties satisfying the materials required by us cannot be obtained. It can be seen from reference examples 5 and 6 that when the area ratio of the Brass orientation {011}<211> with a deviation angle of less than 15° does not satisfy 5% to 37%, the area ratio of the S-type orientation {123}<634> with a deviation angle of less than 15° does not satisfy 5% to 30%, and the bending workability of the material is significantly deteriorated. It can be seen from reference examples 7 and 8 that when the average particle diameter of the material precipitates does not satisfy 5 nm to 50 nm, the bending workability and the stress relaxation resistance of the alloy are remarkably lowered, and the required material properties cannot be satisfied.

TABLE 1

Composition and property test results of Embodiments and references

| | Element content/wt % | | | | | | | | Property index | |
|---|---|---|---|---|---|---|---|---|---|---|
| | Ni | Sn | P | Si | Other | Cu | Ni/(P + Si) | Si/P | Yield strength MPa | Electrical conductivity % IACS |
| Embodiment 1 | 0.89 | 0.92 | 0.06 | 0.020 | — | Balance | 10.8 | 0.32 | 557 | 44.3 |
| Embodiment 2 | 1.07 | 0.95 | 0.13 | 0.186 | — | | 3.4 | 1.46 | 589 | 42.6 |
| Embodiment 3 | 0.92 | 2.21 | 0.08 | 0.174 | — | | 3.6 | 2.18 | 638 | 39.1 |
| Embodiment 4 | 1.31 | 1.13 | 0.03 | 0.172 | — | | 6.5 | 5.73 | 615 | 43.6 |
| Embodiment 5 | 1.60 | 1.08 | 0.08 | 0.228 | — | | 5.1 | 2.76 | 638 | 41.3 |
| Embodiment 6 | 0.82 | 1.76 | 0.03 | 0.074 | — | | 7.7 | 2.23 | 621 | 40.2 |
| Embodiment 7 | 1.94 | 0.54 | 0.20 | 0.365 | — | | 3.4 | 1.86 | 632 | 43.7 |
| Embodiment 8 | 1.84 | 1.99 | 0.11 | 0.111 | — | | 8.3 | 1.01 | 652 | 38.7 |
| Embodiment 9 | 1.30 | 0.79 | 0.03 | 0.060 | Mg: 0.15 | | 14.4 | 2.00 | 605 | 45.2 |
| Embodiment 10 | 1.89 | 1.41 | 0.14 | 0.306 | Zn: 0.2 | | 4.3 | 2.24 | 639 | 40.4 |
| Embodiment 11 | 1.90 | 2.20 | 0.21 | 0.212 | Fe: 0.18 | | 4.5 | 1.02 | 662 | 38.5 |
| Embodiment 12 | 0.42 | 1.53 | 0.05 | 0.013 | Co: 0.38 | | 6.6 | 0.26 | 592 | 41.7 |
| Embodiment 13 | 1.84 | 2.41 | 0.05 | 0.046 | Al: 0.23 | | 19.0 | 0.89 | 661 | 38.1 |
| Embodiment 14 | 1.66 | 2.24 | 0.10 | 0.065 | Zr: 0.08 | | 10.1 | 0.65 | 643 | 38.5 |
| Embodiment 15 | 1.00 | 1.71 | 0.10 | 0.211 | Cr: 0.18 | | 3.2 | 2.02 | 621 | 41.2 |
| Embodiment 16 | 1.18 | 1.97 | 0.04 | 0.030 | Mn: 0.38 | | 16.9 | 0.75 | 637 | 40.8 |
| Embodiment 17 | 1.53 | 1.58 | 0.18 | 0.031 | B: 0.09 | | 7.1 | 0.17 | 638 | 42.3 |
| Embodiment 18 | 1.70 | 0.35 | 0.04 | 0.091 | RE: 0.05 | | 13.2 | 2.42 | 627 | 43.6 |
| Embodiment 19 | 1.02 | 0.99 | 0.07 | 0.152 | Mn: 0.35<br>Al: 0.08 | | 4.7 | 2.32 | 602 | 46.7 |
| Embodiment 20 | 0.75 | 1.23 | 0.05 | 0.150 | Zr: 0.05<br>Cr: 0.18 | | 3.8 | 3.00 | 615 | 41.5 |
| Reference Example 1 | 1.40 | 1.18 | 0.03 | 0.015 | — | | 31.2 | 0.51 | 538 | 41.5 |
| Reference Example 2 | 1.17 | 1.27 | 0.25 | 0.31 | — | | 2.1 | 1.27 | 649 | 32.8 |
| Reference Example 3 | 1.13 | 0.83 | 0.21 | 0.02 | — | | 4.9 | 0.09 | 634 | 36.9 |
| Reference Example 4 | 1.23 | 1.32 | 0.03 | 0.35 | — | | 3.2 | 11.67 | 621 | 36.1 |
| Reference Example 5 | 1.47 | 0.96 | 0.20 | 0.03 | — | | 6.6 | 0.13 | 610 | 40.1 |

TABLE 1-continued

| Composition and property test results of Embodiments and references | | | | | | | | | |
|---|---|---|---|---|---|---|---|---|---|
| Reference Example 6 | 1.06 | 2.09 | 0.24 | 0.03 | — | 4.0 | 0.11 | 622 | 39.5 |
| Reference Example 7 | 1.05 | 0.69 | 0.05 | 0.15 | | 5.3 | 3.00 | 610 | 39.5 |
| Reference Example 8 | 1.53 | 1.10 | 0.07 | 0.23 | | 5.1 | 3.29 | 620 | 40.5 |

| | Property index | | | | | | |
|---|---|---|---|---|---|---|---|
| Element | Ductility | Residual stress | 90° Bending | | Brass Orientation | S type Orientation | Compound Average particle diameter |
| content/wt % | % | rate % | GW | BW | Proportion % | Proportion % | nm |
| Embodiment 1 | 3 | 72 | 0 | 0.5 | 19 | 15 | 7 |
| Embodiment 2 | 2 | 78 | 0.5 | 1.5 | 7 | 23 | 22 |
| Embodiment 3 | 2 | 77 | 1 | 1 | 32 | 28 | 26 |
| Embodiment 4 | 2 | 79 | 1 | 1.5 | 13 | 20 | 18 |
| Embodiment 5 | 2 | 80 | 1 | 1.5 | 25 | 31 | 25 |
| Embodiment 6 | 2 | 78 | 0.5 | 1 | 30 | 17 | 17 |
| Embodiment 7 | 2 | 82 | 0.5 | 1 | 19 | 23 | 26 |
| Embodiment 8 | 1 | 82 | 1 | 2 | 35 | 29 | 36 |
| Embodiment 9 | 2 | 84 | 0.5 | 1 | 27 | 28 | 15 |
| Embodiment 10 | 2 | 81 | 1 | 2 | 22 | 30 | 40 |
| Embodiment 11 | 1 | 82 | 1 | 2 | 36 | 29 | 45 |
| Embodiment 12 | 2 | 75 | 0.5 | 1 | 31 | 6 | 18 |
| Embodiment 13 | 2 | 82 | 1 | 2 | 32 | 26 | 12 |
| Embodiment 14 | 2 | 81 | 1 | 2 | 28 | 20 | 19 |
| Embodiment 15 | 2 | 77 | 0.5 | 1.5 | 17 | 28 | 17 |
| Embodiment 16 | 2 | 75 | 0.5 | 1 | 25 | 24 | 24 |
| Embodiment 17 | 2 | 78 | 0.5 | 1.5 | 26 | 32 | 25 |
| Embodiment 18 | 2 | 79 | 0.5 | 1.5 | 17 | 11 | 37 |
| Embodiment 19 | 2 | 79 | 0.5 | 1 | 35 | 14 | 25 |
| Embodiment 20 | 1 | 75 | 0.5 | 1 | 35 | 21 | 16 |
| Reference Example 1 | 2 | 62 | 0.5 | 1 | 25 | 8 | 17 |
| Reference Example 2 | 2 | 72 | 2 | 2.5 | 21 | 13 | 26 |
| Reference Example 3 | 2 | 71 | 0.5 | 1 | 19 | 18 | 31 |
| Reference Example 4 | 2 | 73 | 0.5 | 1 | 31 | 29 | 27 |
| Reference Example 5 | 2 | 76 | 2 | 3.5 | 40 | 32 | 24 |
| Reference Example 6 | 2 | 73 | 2.5 | 3 | 15 | 35 | 18 |
| Reference Example 7 | 2 | 70 | 2 | 2.5 | 18 | 19 | 61 |
| Reference Example 8 | 2 | 68 | 2 | 3 | 25 | 11 | 58 |

What is claimed is:

1. A copper alloy, consisting of the following components in percentage by weight:

0.4 wt %-2.0 wt % of Ni;

0.2 wt %-0.95 wt % of Sn;

0.02 wt %-0.25 wt % of P;

0.001 wt %-0.091 wt % of Si; and the balance of Cu and unavoidable impurities, wherein a microstructure of the copper alloy contains a Ni—P intermetallic compound and a Ni—Si intermetallic compound, wherein average particle diameters of the Ni—P intermetallic compound and the Ni—Si intermetallic compound are both within a range of 5 nm to 50 nm, wherein the weight percentages of Ni, P, and Si satisfy: $3 \leq Ni/(P+Si) \leq 20$, and the weight percentages of Si and P satisfy: $0.1 \leq Si/P \leq 10$, wherein the crystal orientations of a strip of the copper alloy satisfies: an area ratio of brass orientation {011}<211> with a deviation angle of less than 15° is 5% to 37%, and an area ratio of S-type orientation {123}<634> with a deviation angle of less than 15° is 5% to 30%.

2. A copper alloy, consisting of the following components in percentage by weight:

0.4 wt %-2.0 wt % of Ni;

0.2 wt %-0.95 wt % of Sn;

0.02 wt %-0.25 wt % of P;

0.001 wt %-0.091 wt % of Si;

0.01 wt %-0.5 wt % of Mg and/or 0.1 wt %-2.0 wt % of Zn; and the balance of Cu and unavoidable impurities, wherein a microstructure of the copper alloy contains a Ni—P intermetallic compound and a Ni—Si intermetallic compound, wherein average particle diameters of the Ni—P intermetallic compound and the Ni—Si intermetallic compound are both within a range of 5 nm to 50 nm, wherein the weight percentages of Ni, P, and Si satisfy: $3 \leq Ni/(P+Si) \leq 20$, and the weight percentages of Si and P satisfy: $0.1 \leq Si/P \leq 10$, wherein the crystal orientations of a strip of the copper alloy satisfies: an area ratio of brass orientation {011}<211> with a deviation angle of less than 15° is 5% to 37%, and an area ratio of S-type orientation {123}<634> with a deviation angle of less than 15° is 5% to 30%.

3. A copper alloy, consisting of the following components in percentage by weight:

0.4 wt %-2.0 wt % of Ni;

0.2 wt %-0.95 wt % of Sn;

0.02 wt %-0.25 wt % of P;

0.001 wt %-0.091 wt % of Si;

0.001 wt % to 1.0 wt % of at least one element selected from Fe, Al, Zr, Cr, Mn, B, and RE; and the balance of Cu and unavoidable impurities, wherein a microstructure of the copper alloy contains a Ni—P intermetallic compound and a Ni—Si intermetallic compound, wherein average particle diameters of the Ni—P intermetallic compound and the Ni—Si intermetallic compound are both within a range of 5 nm to 50 nm, wherein the weight percentages of Ni, P, and Si satisfy: $3 \leq Ni/(P+Si) \leq 20$, and the weight percentages of Si and P satisfy: $0.1 \leq Si/P \leq 10$, wherein the crystal orientations of a strip of the copper alloy satisfies: an area ratio of brass orientation {011}<211> with a deviation angle of less than 15° is 5% to 37%, and an area ratio of S-type orientation {123}<634> with a deviation angle of less than 15° is 5% to 30%.

4. The copper alloy according to claim 1, wherein a strip of the copper alloy has a yield strength of 550 MPa or above and an electrical conductivity of 38% IACS or above.

5. The copper alloy according to claim 1, wherein a 90° bending workability of a strip of the copper alloy is as follows: a value of R/t in the GW direction is less than or equal to 1, and a value R/t in the BW direction is less than or equal to 2; after the strip of the copper alloy is kept at 150° C. for 1000 hours, a stress residual rate is 75% or above.

* * * * *